US009335645B2

(12) United States Patent
Tagami et al.

(10) Patent No.: US 9,335,645 B2
(45) Date of Patent: May 10, 2016

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kei Tagami, Numazu (JP); Kunihiko Sekido, Suntou-gun (JP); Masashi Nishi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,043

(22) Filed: Dec. 11, 2014

(65) Prior Publication Data

US 2015/0185633 A1 Jul. 2, 2015

(30) Foreign Application Priority Data

Dec. 26, 2013 (JP) ..... 2013-270561
Dec. 5, 2014 (JP) ..... 2014-246838

(51) Int. Cl.
*G03G 5/14* (2006.01)

(52) U.S. Cl.
CPC . *G03G 5/14* (2013.01); *G03G 5/142* (2013.01)

(58) Field of Classification Search
CPC ..... G03G 5/14; G03G 5/142
USPC ..... 430/62
See application file for complete search history.

(56) References Cited

U.S. PATENT DOCUMENTS 7,541,124 B2 6/2009 Molaire et al.
7,820,780 B2 * 10/2010 Bender ..... C07D 209/48 528/226
7,871,747 B2 1/2011 Shimoyama et al.
8,546,050 B2 10/2013 Maruyama et al.

FOREIGN PATENT DOCUMENTS

JP 2007-108670 A 4/2007
JP 2007-148294 A 6/2007
JP 2008-65173 A 3/2008
JP 2008-250082 A 10/2008
JP 2009-505156 A 2/2009

OTHER PUBLICATIONS

Fujiyama, et al., "Development of New Electron Transport Material with High Drift Mobility", Journal of the Imaging Society of Japan, vol. 45, No. 6, 2006, pp. 521-525.
Fujiyama, et al., "Development of New Electron Transport Material with High Drift Mobility", Journal of the Imaging Society of Japan, vol. 45, No. 6, 2000, pp. 521-525.
U.S. Appl. No. 14/564,969, filed Dec. 9, 2014. Inventor: Kunihiko Sekido, et al.
U.S. Appl. No. 14/568,047, filed Dec. 11, 2014. Inventor: Masashi Nishi, et al.

* cited by examiner

*Primary Examiner* — Peter Vajda
(74) *Attorney, Agent, or Firm* — Fitzpatrick, Cella, Harper and Scinto

(57) ABSTRACT

An electrophotographic photosensitive member includes a support; an undercoat layer formed on the support; and a photosensitive layer formed on the undercoat layer, in which the undercoat layer contains a specific polymerized product (cured product).

15 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, a process cartridge and an electrophotographic apparatus each having the electrophotographic photosensitive member.

2. Description of the Related Art

Among the electrophotographic photosensitive member, an electrophotographic photosensitive member using an organic photoconductive material has good film formability and can be produced by coating. Therefore, it has an advantage of high productivity.

The electrophotographic photosensitive member generally has a support and a photosensitive layer formed on the support, and in the photosensitive layer, a charge generating material and a hole transport material are used. Further, an undercoat layer is frequently provided between the support and the photosensitive layer for the purpose of suppressing charge injection from the support to the photosensitive layer side and occurrence of image defects such as black spots.

In recent years, a charge generating material having higher sensitivity has been used. However, as the charge generating material has higher sensitivity, the amount of charge generated is increased. Therefore, the charge easily stagnates in the photosensitive layer, and positive ghosting is easily generated. The positive ghosting is a phenomenon in which the density of only the portion irradiated with light at the prior rotation becomes deep while forming one sheet of the image.

As a technique of suppressing such positive ghosting, Japanese Patent Application Laid-Open No. 2007-148294, Japanese Patent Application Laid-Open No. 2008-250082, National Publication of International Patent Application No. 2009-505156, and Japanese Patent Application Laid-Open No. 2008-65173 each describe a technique of allowing an electron transport material to be contained in an undercoat layer. These patents further describe a technique of curing the undercoat layer so that, when an electron transport material is allowed to be contained in an undercoat layer, the electron transport material may not be eluted into a solvent in a coating liquid for a photosensitive layer during the formation of a photosensitive layer which is the upper layer of the undercoat layer.

In recent years, requirements for the quality of electrophotographic images have been increasing, and the tolerance to the positive ghosting as described above has become significantly severe.

As a result of investigations by the inventors, it has been found that the techniques described in the above literatures still have room for improvement with respect to the suppression (reduction) of positive ghosting, particularly the variation of the positive ghosting level before and after continuous image output.

SUMMARY OF THE INVENTION

An object of the present invention is to provide an electrophotographic photosensitive member in which positive ghosting is suppressed, as well as a process cartridge and an electrophotographic apparatus each having the electrophotographic photosensitive member. The present invention provides an electrophotographic photosensitive member including:

a support;

an undercoat layer formed on the support; and a photosensitive layer formed on the undercoat layer, wherein the undercoat layer comprises following (i) or (ii), (i) a polymerized product of at least one compound selected from the group consisting of a compound represented by the following formula (1) and a compound represented by the following formula (2), (ii) a polymerized product of a composition comprising at least one compound selected from the group consisting of a compound represented by the following formula (1) and a compound represented by the following formula (2), (1)

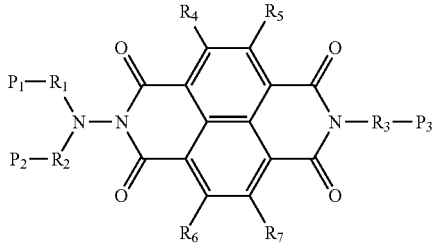

(2)

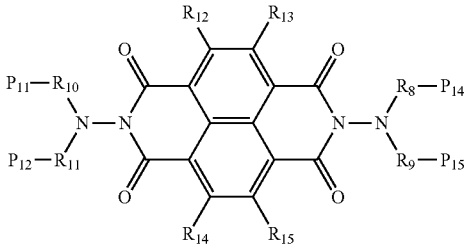

wherein, in the formulae (1) and (2), $R_1$ to $R_3$ and $R_8$ to $R_{11}$ each independently represent a hydrogen atom, an unsubstituted or substituted arylene group, an unsubstituted or substituted hetero ring, an unsubstituted or substituted alkylene group having 1 to 6 main-chain atoms, a divalent group having 1 to 6 main-chain atoms and derived from one of $CH_2$ in the main chain of an unsubstituted or substituted alkylene group substituted for an oxygen atom, or a divalent group having 1 to 6 main-chain atoms and derived from one of $CH_2$ in the main chain of an unsubstituted or substituted alkylene group substituted for a sulfur atom, a substituent of the substituted alkylene group is an alkyl group having 1 to 6 carbon atoms, a benzyl group, an alkoxycarbonyl group, or a phenyl group, $R_1$ may combine with $R_2$ to form an unsubstituted or substituted hetero ring, $P_2$ is absent when $R_1$ combines with $R_2$ to form the hetero ring, $R_8$ may combine with $R_9$ to form an unsubstituted or substituted hetero ring, $P_{15}$ is absent when $R_8$ combines with $R_9$ to form the hetero ring, $R_{10}$ may combine with $R_{11}$ to form an unsubstituted or substituted hetero ring, $P_{12}$ is absent when $R_{10}$ combines with $R_{11}$ to form the hetero ring, $R_4$ to $R_7$ and $R_{12}$ to $R_{15}$ each independently represent a hydrogen atom, a cyano group, a nitro group, a halogen atom, an unsubstituted or substituted alkyl group, or an unsubstituted or substituted aryl group, $P_1$ is absent when $R_1$ is a hydrogen atom, $P_2$ is absent when $R_2$ is a hydrogen atom, $P_3$ is absent when $R_3$ is a hydrogen atom, $P_{14}$ is absent when $R_8$ is a hydrogen atom, $P_{15}$ is absent when $R_9$ is a hydrogen atom, $P_{11}$ is absent when $R_{10}$ is a hydrogen atom, $P_{12}$ is absent when $R_{11}$ is a hydrogen atom, in the formula (1), $P_1$ to $P_3$ each independently a hydrogen atom or a polymerizable functional group, at least one of $P_1$ to $P_3$ is a polymerizable functional group, and in the formula (2), $P_{11}$, $P_{12}$, $P_{14}$ and $P_{15}$ each independently a hydrogen atom or a polymerizable functional group, at least one of $P_{11}$, $P_{12}$, $P_{14}$ and $P_{15}$ is a polymerizable functional group.

The present invention further provides a process cartridge detachably attachable to the main body of an electrophotographic apparatus, wherein the process cartridge integrally supports: the electrophotographic photosensitive member; and at least one device selected from the group consisting of a charging device, a developing device and a cleaning device.

The present invention further provides an electrophotographic apparatus comprising the electrophotographic photosensitive member, a charging device, an image exposure device, a developing device, and a transfer device.

The present invention can provide an electrophotographic photosensitive member in which positive ghosting is suppressed, as well as a process cartridge and an electrophotographic apparatus each having the electrophotographic photosensitive member.

Further features of the present invention will become apparent from the following description of exemplary embodiments with reference to the attached drawings.

DESCRIPTION OF THE EMBODIMENTS

Figure 1:
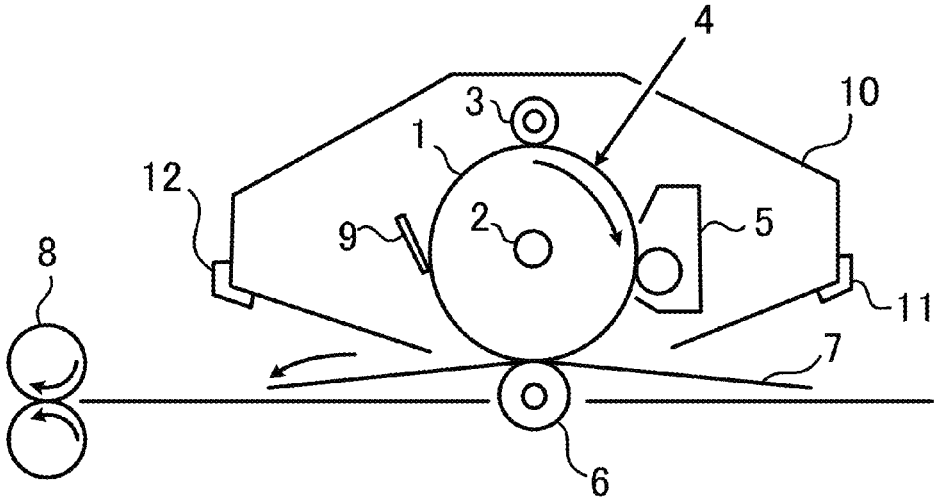
FIG. 1 is a diagram illustrating a schematic structure of an electrophotographic apparatus having a process cartridge provided with the electrophotographic photosensitive member of the present invention.

Preferred embodiments of the present invention will now be described in detail in accordance with the accompanying drawings.

The electrophotographic photosensitive member of the present invention has a support; an undercoat layer formed on the support; and a photosensitive layer containing a charge generating material and a hole transport material formed on the undercoat layer, wherein the undercoat layer contains a polymerized product (cured product) of the following (i) or (ii):

(i) a polymerized product (cured product) of at least one compound selected from the group consisting of a compound represented by the following formula (1) and a compound represented by the following formula (2), (ii) a polymerized product (cured product) of a composition including at least one compound selected from the group consisting of a compound represented by the following formula (1) and a compound represented by the following formula (2).

(1)

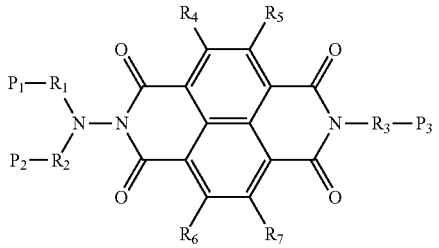

(2)

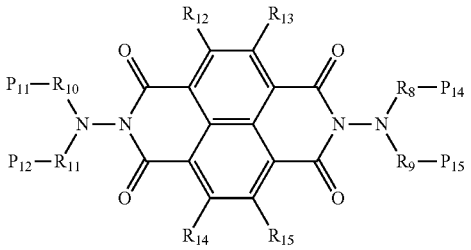

In the formulae (1) and (2), $R_1$ to $R_3$ and $R_8$ to $R_{11}$ each independently represent a hydrogen atom, an unsubstituted or substituted arylene group, an unsubstituted or substituted hetero ring group, an unsubstituted or substituted alkylene group having 1 to 6 main-chain carbon atoms, a divalent group having 1 to 6 main-chain carbon atoms and derived from substitution of an oxygen atom for one of $CH_2$ in the main chain of an unsubstituted or substituted alkylene group, or a divalent group having 1 to 6 main-chain carbon atoms and derived from substitution of a sulfur atom for one of $CH_2$ in the main chain of an unsubstituted or substituted alkylene group, a substituent of the substituted alkylene group is an alkyl group having 1 to 6 carbon atoms, a benzyl group, an alkoxycarbonyl group, or a phenyl group, $R_1$ may combine with $R_2$ to form an unsubstituted or substituted hetero ring $P_2$ is absent when $R_1$ combines with $R_2$ to form the hetero ring, $R_8$ may combine with $R_9$ to form an unsubstituted or substituted hetero ring, $P_{15}$ is absent when $R_8$ combines with $R_9$ to form the hetero ring, $R_{10}$ may combine with $R_{11}$ to form an unsubstituted or substituted hetero ring, $P_{12}$ is absent when $R_{10}$ combines with $R_{11}$ to form the hetero ring, $R_4$ to $R_7$ and $R_{12}$ to $R_{15}$ each independently represent a hydrogen atom, a cyano group, a nitro group, a halogen atom, an unsubstituted or substituted alkyl group, or an unsubstituted or substituted aryl group, $P_1$ is absent when $R_1$ is a hydrogen atom, $P_2$ is absent when $R_2$ is a hydrogen atom, $P_3$ is absent when $R_3$ is a hydrogen atom, $P_{14}$ is absent when $R_8$ is a hydrogen atom, $P_{15}$ is absent when $R_9$ is a hydrogen atom, $P_{11}$ is absent when $R_{10}$ is a hydrogen atom, $P_{12}$ is absent when $R_{11}$ is a hydrogen atom, in the formula (1), $P_1$ to $P_3$ each independently represent a hydrogen atom or a polymerizable functional group, at least one of $P_1$ to $P_3$ represents a polymerizable functional group, in the formula (2), $P_{11}$, $P_{12}$, $P_{14}$ and $P_{15}$ each independently represent a hydrogen atom or a polymerizable functional group, and at least one of $P_{11}$, $P_{12}$, $P_{14}$ and $P_{15}$ represents a polymerizable functional group.

The reason why the electrophotographic photosensitive member having an undercoat layer containing a polymerized product (cured product) according to the present invention is excellent in high positive ghosting suppression effect is estimated by the inventors as follows. Since a nitrogen atom is present at the adjacent position of 1,4,5,8-naphthalenetetracarboxylic diimide, an interaction by a hydrogen bond will occur between 1,4,5,8-naphthalenetetracarboxylic diimides. As a result, 1,4,5,8-naphthalenetetracarboxylic diimides which are electron transport parts will approach to each other to improve the delivery of electrons, leading to a high suppression effect on the positive ghosting caused by the stagnation of electrons.

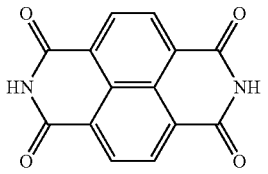

1,4,5,8-naphthalenetetracarboxylic diimide

[Support]

A support can be a support having conductivity (conductive support), and examples thereof that can be used include a support made of metal such as aluminum, nickel, copper, gold and iron, and a support made of an alloy of these metals. Examples further include a support in which a thin film of metal such as aluminum, silver and gold or a thin film of a conductive material such as indium oxide and tin oxide is formed on an insulating support such as polyester, polycarbonate, polyimide and glass.

The surface of the support may be subjected to electrochemical treatment such as anodic oxidation and treatment such as wet honing, a blast and cutting in order to improve electrical characteristics and suppress interference fringes which are easily generated during irradiation of coherent light such as a semiconductor laser.

[Undercoat Layer]

An undercoat layer is provided between a charge generating layer and a support.

In the present invention, an undercoat layer containing a polymerized product of a compound having a polymerizable functional group is formed on the support. The compound is cured after a coating film of a coating liquid for the undercoat layer is formed, and at this time, the curing reaction is accelerated by applying energy such as heat to the coating film.

The content of the polymerized product of the present invention in the undercoat layer is preferably 50% by mass or more and 100% by mass or less, more preferably 80% by mass or more and 100% by mass or less based on the total mass of the undercoat layer.

The undercoat layer may contain additives such as a resin, a crosslinking agent, organic particles, inorganic particles and a leveling agent in addition to the compound as described above, in order to improve film formability and electrical characteristics. However, the content of these additives in the undercoat layer is preferably less than 50% by mass, more preferably less than 20% by mass based on the total mass of the undercoat layer.

When the undercoat layer contains a polymerized product of a composition containing a compound having a polymerizable functional group, a crosslinking agent and a resin, the mass ratio of the compound represented by the above formula (1) and/or the compound represented by the above formula (2) to the crosslinking agent in the undercoat layer can be in the range to be shown below. Specifically, the range is 100:50 or more and 100:250 or less.

[Crosslinking Agent]

A crosslinking agent which may be contained in an undercoat layer may be any compound as long as the compound can participate in the crosslinking of materials contained in the undercoat layer. Examples of commercially available crosslinking agents include an isocyanate compound having an isocyanate group or a blocked isocyanate group and an amine compound having an N-methylol group or an alkyl-etherified N-methylol group as shown below. However, the present invention is not limited to these compounds. Further, a plurality of crosslinking agents may be used in combination with each other.

The isocyanate compound can be an isocyanate compound having a plurality of (two or more) isocyanate groups or blocked isocyanate groups. Examples include tri-isocyanate benzene, tri-isocyanate methylbenzene, triphenylmethane tri-isocyanate, lysine tri-isocyanate, and, in addition, isocyanurate-modified products, biuret-modified products and allophanate-modified products of diisocyanate such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethyl hexamethylene diisocyanate, methyl-2,6-diisocyanate hexanoate and norbornane diisocyanate, and adduct-modified products of any of these diisocyanates with trimethylolpropane and pentaerythritol. Among these, the isocyanurate-modified products and the adduct-modified products are more preferred.

Examples of commercially available isocyanate compounds (crosslinking agents) include isocyanate crosslinking agents such as Duranate MFK-60B and SBA-70B manufactured by Asahi Kasei Corporation and Desmodur BL3175 and BL3475 manufactured by Sumika Bayer Urethane Co., Ltd., amino crosslinking agents such as U-VAN 20SE60 and 220 manufactured by Mitsui Chemicals, Inc. and SUPER BECKAMINE L-125-60 and G-821-60 manufactured by DIC Corporation, and acrylic crosslinking agents such as FANCRYL FA-129AS and FA-731A manufactured by Hitachi Chemical Co., Ltd.

The amine compound can be, for example, an amine compound having a plurality of (two or more) N-methylol groups or alkyl-etherified N-methylol groups. Examples include methylolated melamine, methylolated guanamine, a methylolated urea derivative, a methylolated ethyleneurea derivative, methylolated glycoluril, compounds in which the methylol part of these compounds is alkyl etherified, and derivatives thereof.

Examples of commercially available amine compounds (crosslinking agents) include Super Melamine No. 90 (manufactured by NOF Corporation), SUPER BECKAMINE (®) TD-139-60, L-105-60, L127-60, L110-60, J-820-60 and G-821-60 (manufactured by DIC Corporation), U-VAN 2020 (Mitsui Chemicals, Inc.), Sumitex resin M-3 (Sumitomo Chemical Co., Ltd.), NIKALAC MW-30, MW-390 and MX-750LM (manufactured by NIPPON CARBIDE INDUSTRIES CO., INC.), SUPER BECKAMINE (R) L-148-55, 13-535, L-145-60 and TD-126 (manufactured by DIC Corporation), NIKALAC BL-60 and BX-4000 (manufactured by NIPPON CARBIDE INDUSTRIES CO., INC.), and NIKALAC MX-280, NIKALAC MX-270 and NIKALAC MX-290 (manufactured by NIPPON CARBIDE INDUSTRIES CO., INC.).

[Resin]

Any resin may be contained in the undercoat layer. Examples of commercially available resins include polyether polyol resins, polyester polyol resins, polyacrylic polyol resins, polyvinyl alcohol resins, polyvinyl acetal resins, polyamide resins, carboxyl group-containing resins, polyamine resins, and polythiol resins. However, the present invention is not limited to these reins. Further, a plurality of resins may be used in combination with each other.

Examples of available resins having a polymerizable functional group include polyether polyol resins such as AQD-457 and AQD-473 manufactured by Nippon Polyurethane Industry Co., Ltd. and SANNIX GP-400 and GP-700 manufactured by Sanyo Chemical Industries, Ltd.; polyester polyol resins such as PHTHALKYD W2343 manufactured by Hitachi Chemical Co., Ltd., WATERSOL S-118 and CD-520 manufactured by DIC Corporation, HARIDIP WH-1188 manufactured by Harima Chemicals Inc.,; polyacrylic polyol resins such as BURNOCK WE-300 and WE-304 manufactured by DIC Corporation; polyvinyl alcohol resins such as Kuraray Poval PVA-203 manufactured by Kuraray Co., Ltd.; polyvinyl acetal resins such as BX-1, BM-1, KS-1 and KS-5 manufactured by Sekisui Chemical Co., Ltd.; polyamide resins such as TORESIN FS-350 manufactured by Nagase ChemteX Corporation; carboxy group-containing resins such as AQUALIC manufactured by Nippon Shokubai Co., Ltd. and FINELEX SG2000 manufactured by Namariichi Co., Ltd.; polyamine resins such as LUCKAMIDE manufactured by DIC Corporation; and polythiol resins such as QE-340M manufactured by Toray Industries Inc.

In the above formulae (1) and (2), examples of the arylene group include a phenylene group, a naphthylene group, a biphenylylene group and a fluorenylene group.

In the above general formulae (1) and (2), examples of the hetero ring group include divalent groups derived from thiophene, pyrrole, pyridine, pyrazine, pyrimidine, pyridazine, triazine, quinoline, isoquinoline, oxazole, oxadiazole, phenanthridine, acridine, naphthyridine, quinoxaline, quinazoline, cinnoline, phthalazine, phenanthroline, phenazine, dibenzofuran, dibenzothiophene, carbazole, benzofuran, benzothiophene, indole, benzimidazole, benzothiazole and benzothiadiazole by removing two hydrogen atoms.

Examples of the above substituent, that is, the substituent on the arylene group and the hetero ring group in the above general formulae (1) and (2) include an alkyl group such as a methyl group, an ethyl group, a propyl group and a butyl group, an aralkyl group such as a benzyl group, an aryl group such as a phenyl group and a biphenyl group, a hetero ring group such as a pyridyl group, a pyrrolyl group, a benzoimidazolyl group and a benzothiazolyl group, an alkoxyl group such as a methoxyl group, an ethoxyl group, a propoxyl group and a phenoxyl group, a cyano group, a nitro group, and a halogen atom such as fluorine, chlorine, bromine and iodine.

Examples of the polymerizable functional group include an active hydrogen group and an unsaturated hydrocarbon group. The active hydrogen group can be a hydroxy group, a carboxyl group, an amino group, a thiol group and a methoxy group. Among these groups, a hydroxy group and a carboxyl group are more preferred. The unsaturated hydrocarbon group can be an acryloyloxy group and a methacryloyloxy group.

The above formulae (1) and (2) can have at least two polymerizable functional groups.

In the above formulae (1) and (2), a hetero ring group in which $R_1$ combines with $R_2$, a hetero ring group in which $R_8$ combines with $R_9$ and a hetero ring group in which $R_{10}$ combines with $R_{11}$ can be selected from the following group. Note that, in the formulae, $P_6$ represents $P_1$, $P_{11}$ or $P_{14}$.

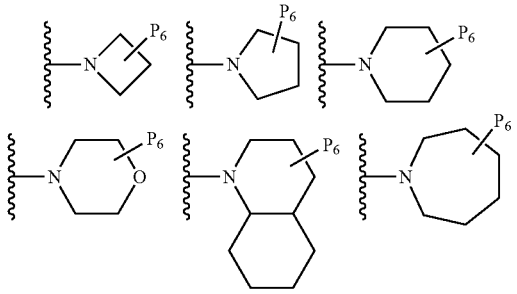

Subsequently, specific examples of the imide compound according to the present invention is shown in Tables 1 to 5. However, the present invention is not limited to these examples. Further, a plurality of imide compounds may be used in combination with each other.

In Table 1, illustrated compounds (E1) to (E20) are examples of compounds represented by the above formula (1) each having two or more polymerizable functional groups.

TABLE 1

| No. | Illustrated compound |
|---|---|
| E1 | 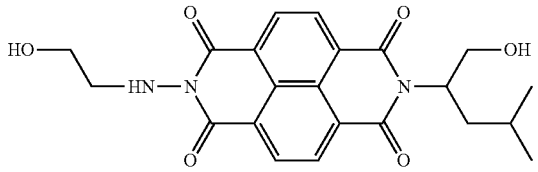 |
| E2 | 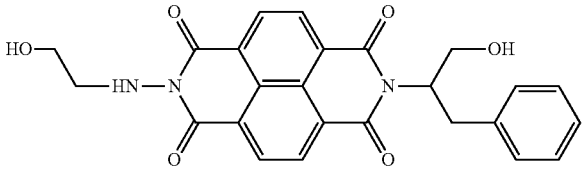 |

TABLE 1-continued
| No. | Illustrated compound |
|---|---|
| E3 | 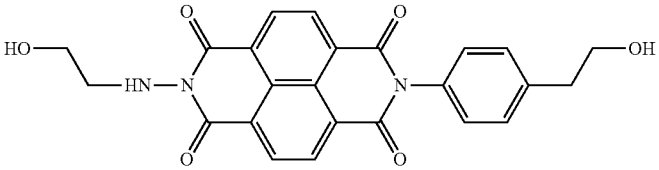 |
| E4 | 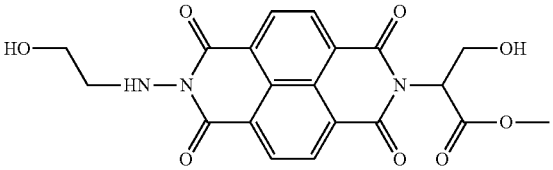 |
| E5 | 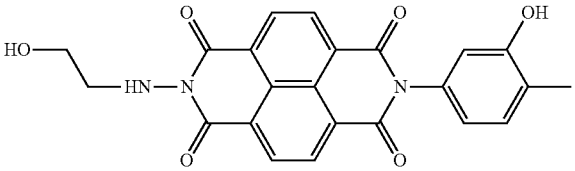 |
| E6 | 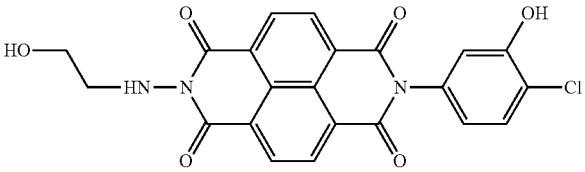 |
| E7 | 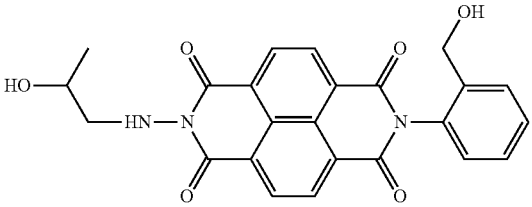 |
| E8 | 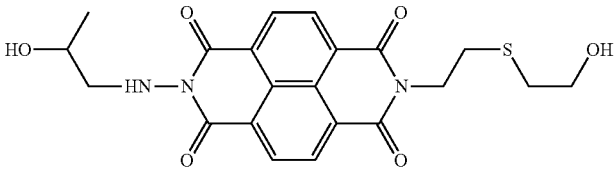 |
| E9 | 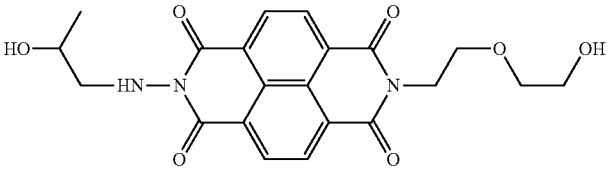 |
| E10 | 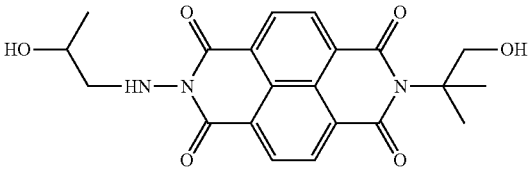 |

TABLE 1-continued
| No. | Illustrated compound |
|---|---|
| E11 | 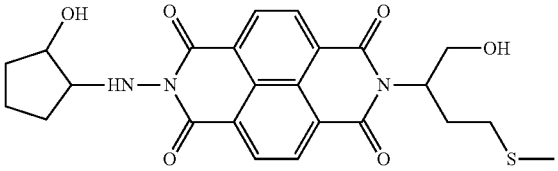 |
| E12 | 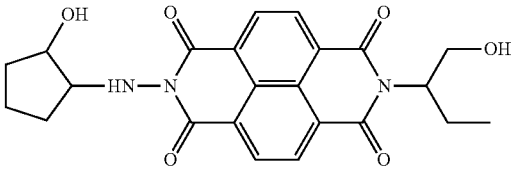 |
| E13 | 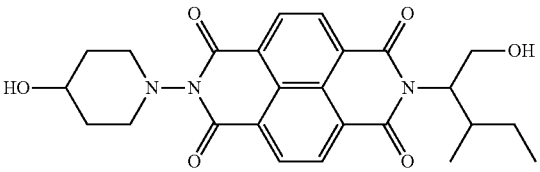 |
| E14 | 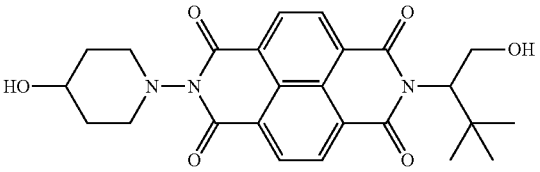 |
| E15 | 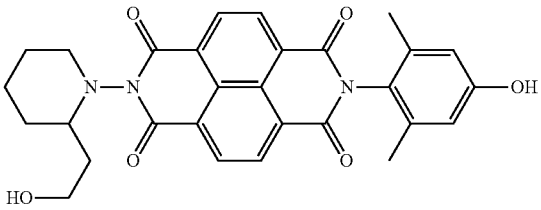 |
| E16 | 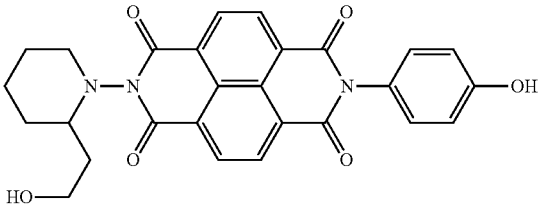 |
| E17 | 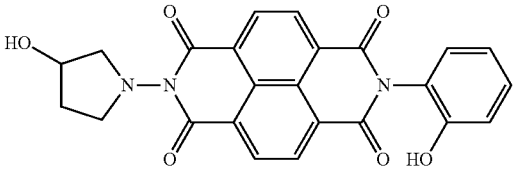 |
| E18 | 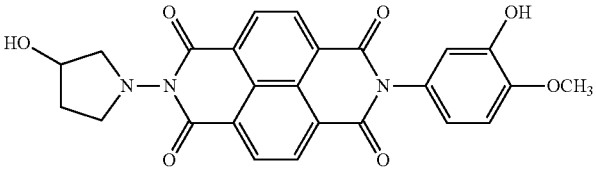 |

TABLE 1-continued
| No. | Illustrated compound |
|---|---|
| E19 | 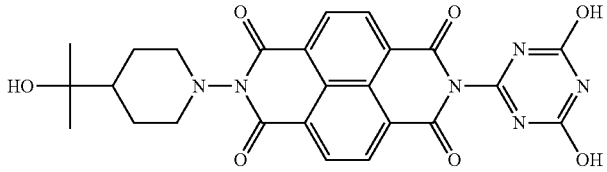 |
| E20 | 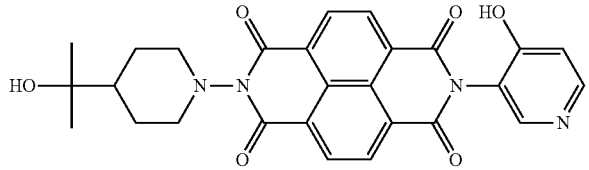 |
In Table 2, illustrated compounds (E21) to (E30) are examples of compounds represented by formula (2) each having two or more polymerizable functional groups.
TABLE 2
| No. | Illustrated compound |
|---|---|
| E21 | 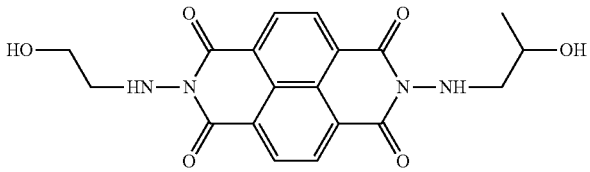 |
| E22 | 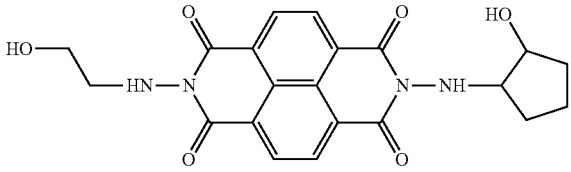 |
| E23 | 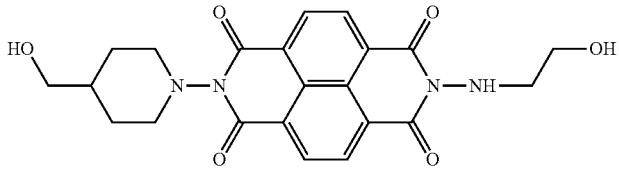 |
| E24 | 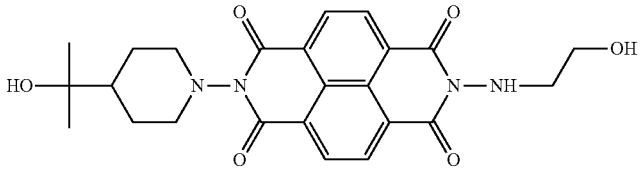 |
| E25 | 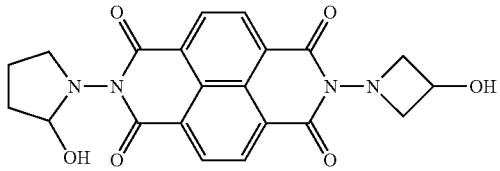 |

TABLE 2-continued
| No. | Illustrated compound |
|---|---|
| E26 | 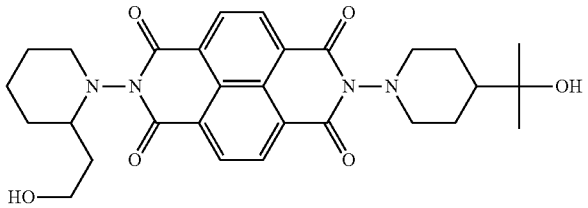 |
| E27 | 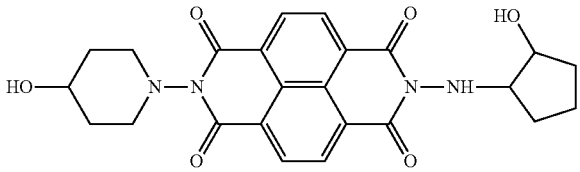 |
| E28 | 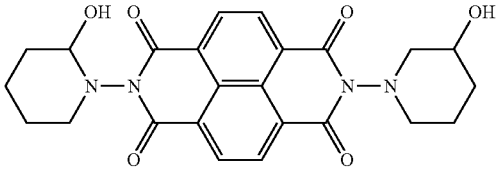 |
| E29 | 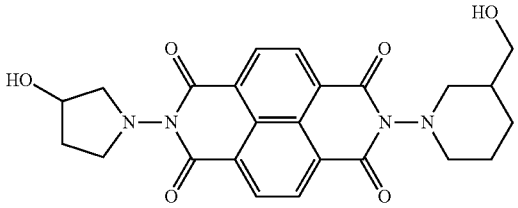 |
| E30 | 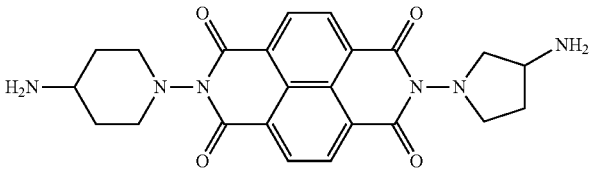 |
In Table 3, illustrated compounds (E31) to (E44) are examples of compounds represented by formula (2) each having two polymerizable functional groups and in which $R_{10}$ is the same as $R_8$, $R_{11}$ is the same as $R_9$, $P_{11}$ is the same as $P_{14}$, and $P_{12}$ is the same as $P_{15}$.
TABLE 3
| No. | Illustrated compound |
|---|---|
| E31 | 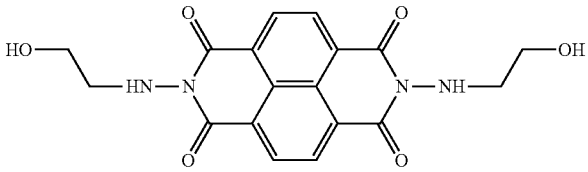 |
| E32 | 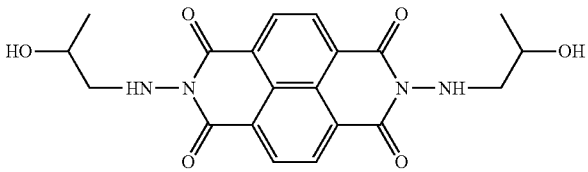 |

TABLE 3-continued
| No. | Illustrated compound |
|---|---|
| E33 | 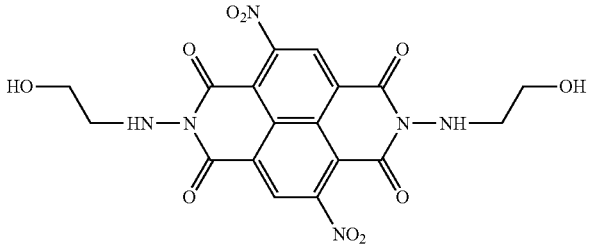 |
| E34 | 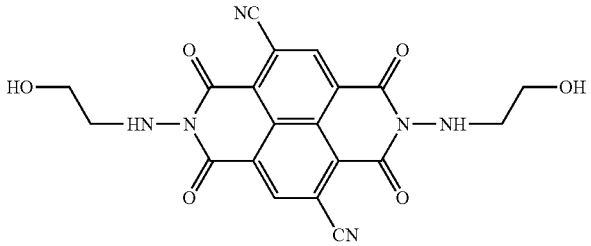 |
| E35 | 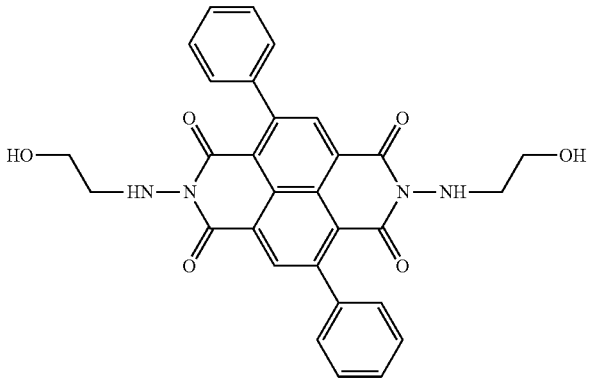 |
| E36 | 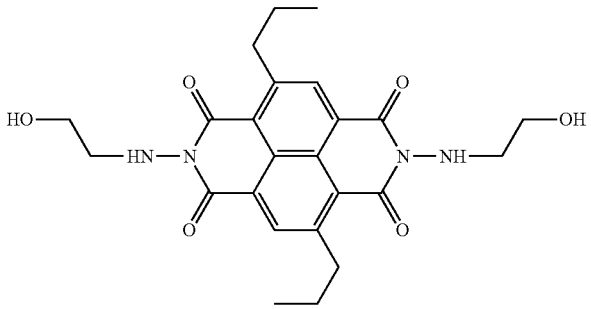 |
| E37 | 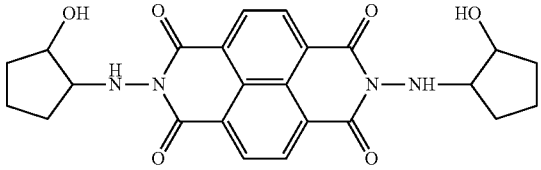 |
| E38 | 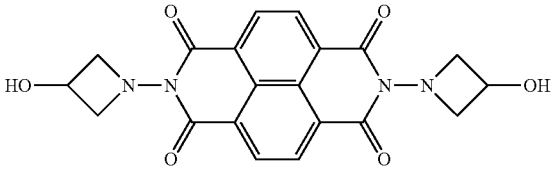 |

TABLE 3-continued
| No. | Illustrated compound |
|---|---|
| E39 | 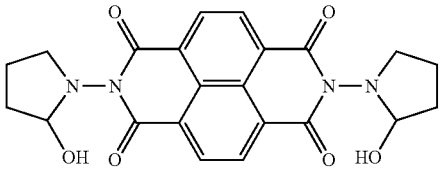 |
| E40 | 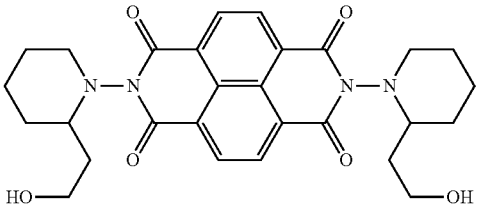 |
| E41 | 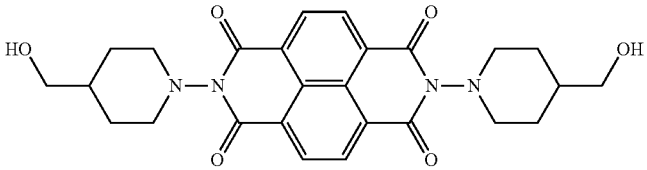 |
| E42 | 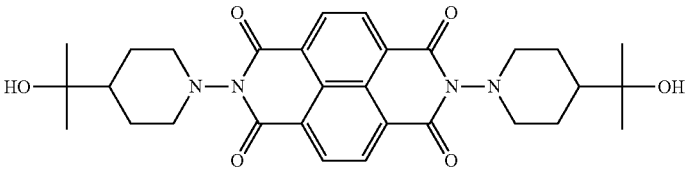 |
| E43 | 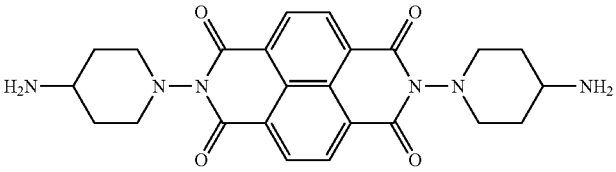 |
| E44 | 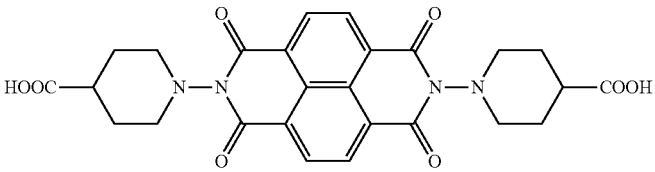 |
In Table 4, illustrated compounds (E45) to (E68) are examples of compounds represented by formula (1) each having one polymerizable functional group.
TABLE 4
| No. | Illustrated compound |
|---|---|
| E45 | 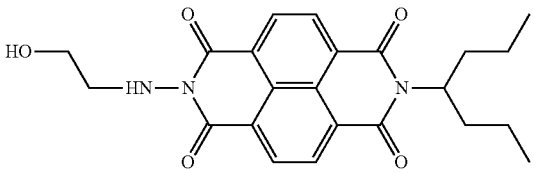 |
TABLE 4-continued
| No. | Illustrated compound |
|---|---|
| E46 | 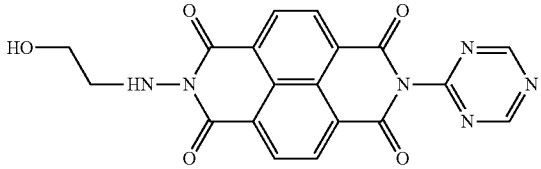 |
| E47 | 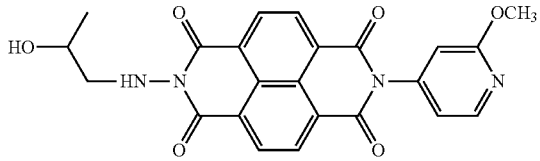 |

TABLE 4-continued
| No. | Illustrated compound |
|---|---|
| E48 | 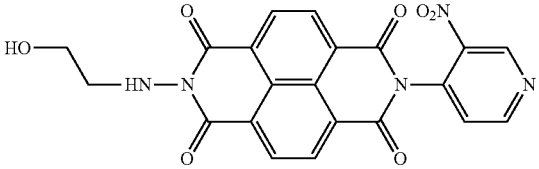 |
| E49 | 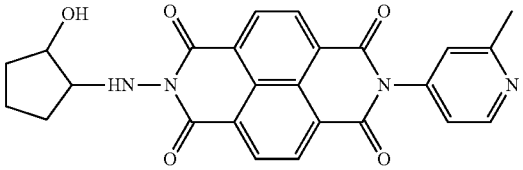 |
| E50 | 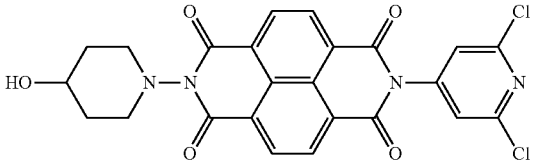 |
| E51 | 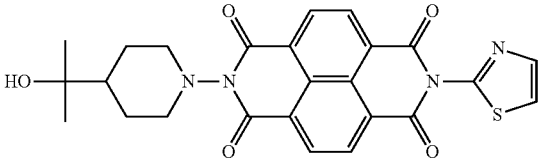 |
| E52 | 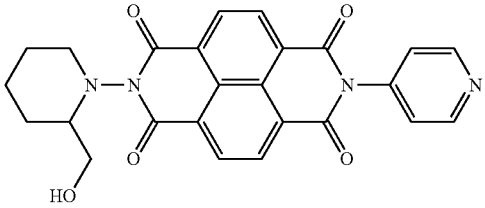 |
| E53 | 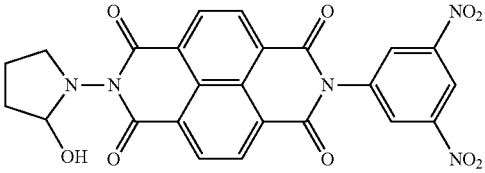 |
| E54 | 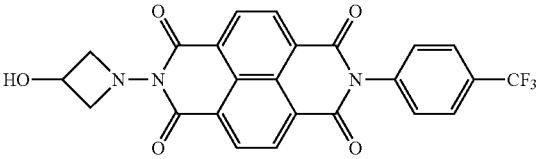 |
| E55 | 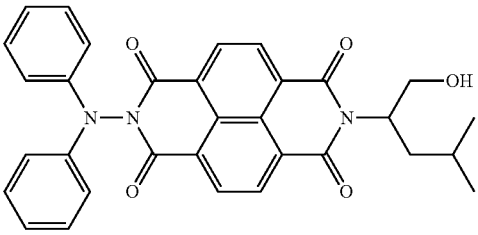 |
TABLE 4-continued
| No. | Illustrated compound |
|---|---|
| E56 | 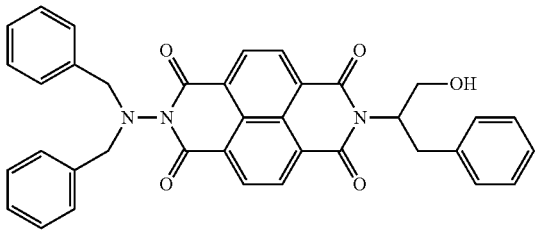 |
| E57 | 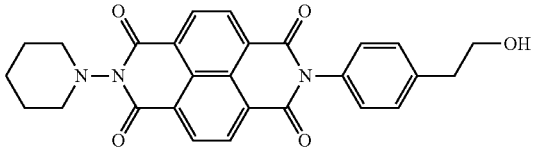 |
| E58 | 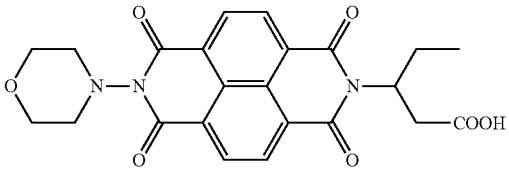 |
| E59 | 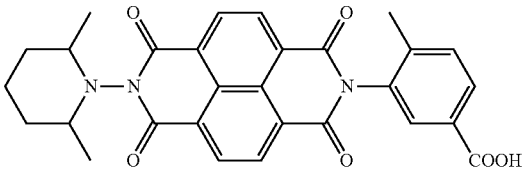 |
| E60 | 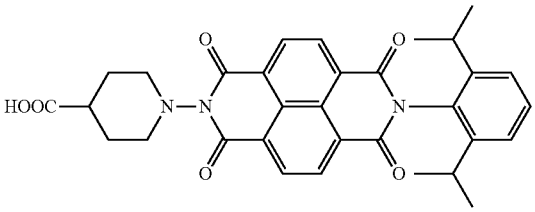 |
| E61 | 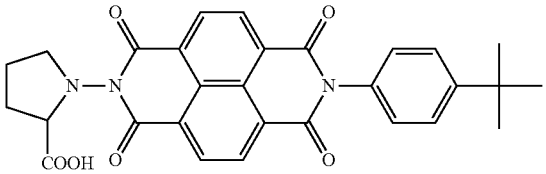 |
| E62 | 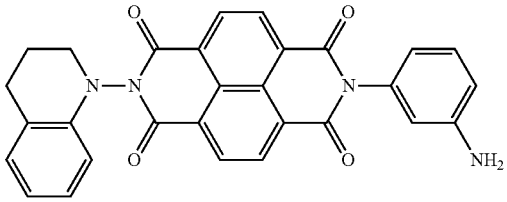 |
| E63 | 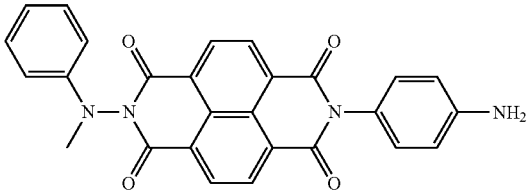 |

TABLE 4-continued
| No. | Illustrated compound |
|---|---|
| E64 | 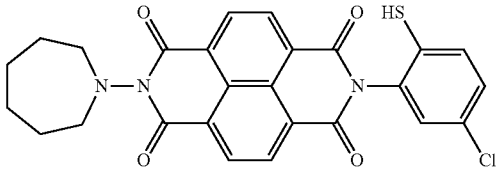 |
| E65 | 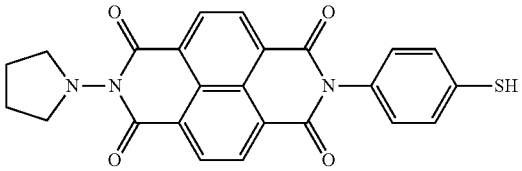 |
| E66 | 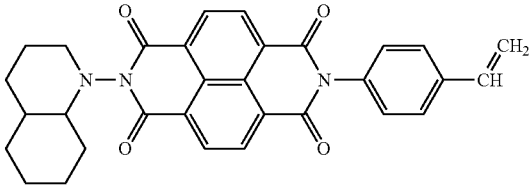 |
| E67 | 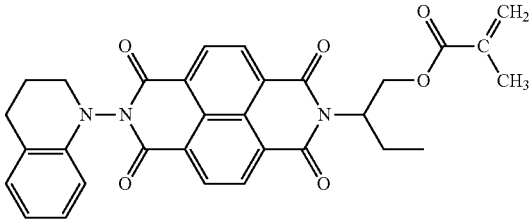 |
| E68 | 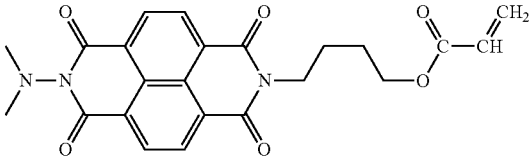 |
In Table 5, illustrated compounds (E69) to (E78) are examples of compounds represented by formula (2) each having one polymerizable functional group.
TABLE 5
| No. | Illustrated compound |
|---|---|
| E69 | 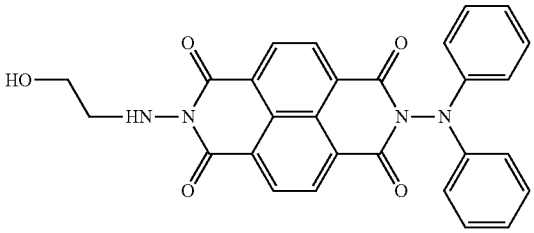 |
TABLE 5-continued
| No. | Illustrated compound |
|---|---|
| E70 | 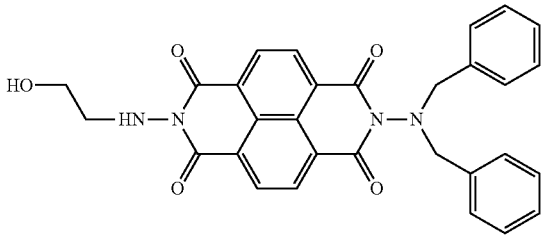 |
| E71 | 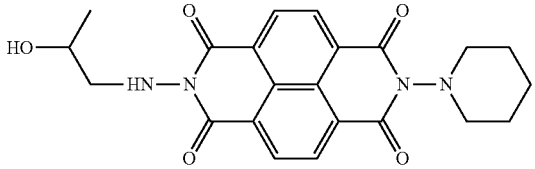 |
| E72 | 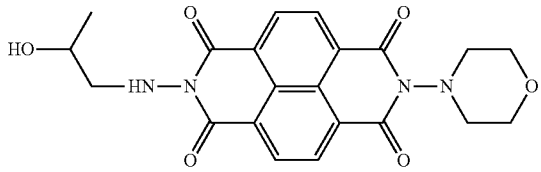 |
| E73 | 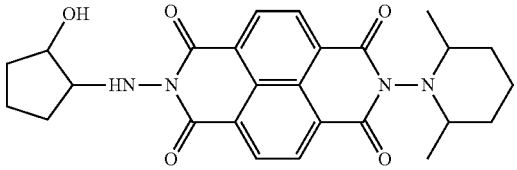 |
| E74 | 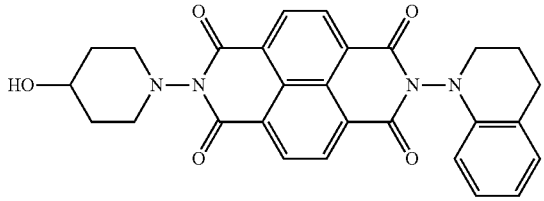 |
| E75 | 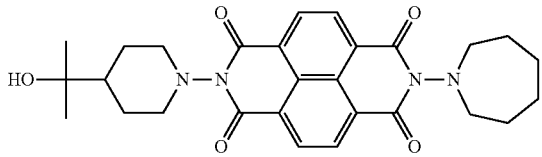 |
| E76 | 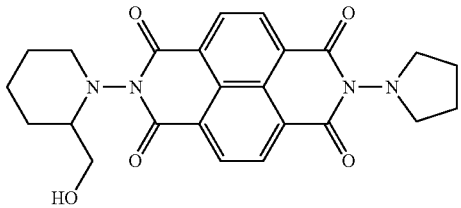 |
| E77 | 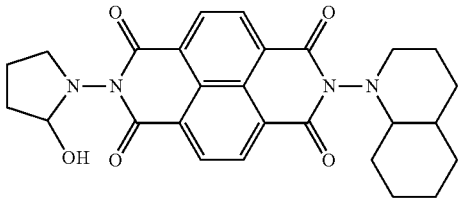 |

TABLE 5-continued

| No. | Illustrated compound |
|---|---|
| E78 | 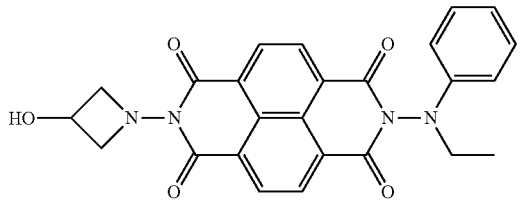 |

The derivatives having a structure represented by formula (1) or formula (2) in the present invention can be synthesized by known synthetic methods described, for example, in Japanese Patent Application Laid-Open No. 2007-108670 and Journal of the Imaging Society of Japan 45 (6), 521-525 (2006). For example, the derivatives can be synthesized by a reaction of naphthalenetetracarboxylic dianhydride with a monoamine derivative and hydrazine, which are commercially available as reagents from Tokyo Chemical Industry Co., Ltd., Sigma-Aldrich Japan K.K. and Johnson Matthey Japan Incorporated.

Further, two methods can be used to introduce a polymerizable functional group into a derivative having a structure represented by formula (1) or (2). One of the methods includes a method of directly introducing any of polymerizable functional groups into a derivative having a structure represented by formula (1) or (2). The other method includes a method of introducing a structure having a polymerizable functional group or a functional group that can be a precursor of a polymerizable functional group into a derivative having a structure represented by formula (1) or (2). Specifically, the second method includes, for example, a method of subjecting a halide of a naphthylimide derivative to a cross-coupling reaction using, for example, a palladium catalyst and a base to introduce a functional group-containing aryl group. Another method includes a method of subjecting to a cross-coupling reaction using a $FeCl_3$ catalyst and a base to introduce a functional group-containing alkyl group. Another method includes a method of subjecting a halide of a naphthylimide derivative to lithiation followed by allowing an epoxy compound or $CO_2$ to act on the lithiated compound to introduce a hydroxyalkyl group or a carboxyl group, respectively.

Further, the following methods can be employed for introducing an unsaturated hydrocarbon group (for example, acrylic, methacrylic or styrene) into a derivative having a structure represented by formula (1) or formula (2). That is, one method includes a method of allowing a monoamine having an unsaturated hydrocarbon group to act on a derivative having a structure represented by formula (1) or formula (2). Another method includes a method of allowing an acrylate to act on a derivative having a hydroxy group which has a structure represented by formula (1) or formula (2). Another method includes a method of directly introducing a polymerizable functional group into a derivative having a structure represented by formula (1) or formula (2).

[Photosensitive Layer]

A photosensitive layer containing a charge generating material and a hole transport material is provided on the undercoat layer.

The photosensitive layer includes a lamination type photosensitive layer in which a charge generating layer containing a charge generating material and a hole transport layer containing a hole transport material are laminated in this order from the support side and a monolayer type photosensitive layer in which a charge generating material and a hole transport material are contained in the same layer. The charge generating layer and the hole transport layer may be provided in plural numbers, respectively.

Examples of the charge generating material include an azo pigment such as monoazo, bisazo and trisazo pigments, a perylene pigment such as perylene anhydride and perylene imide, a quinone pigment such as an anthraquinone derivative, an anthanthrone derivative, a dibenzpyrene quinone derivative, a pyranthrone derivative, a violanthrone derivative and an isoviolanthrone derivative, an indigoid pigment such as an indigo derivative and a thioindigo derivative, a phthalocyanine pigment such as a metal phthalocyanine and a non-metal phthalocyanine, and a perinone pigment such as a bisbenzimidazole derivative. Among these, an azo pigment and a phthalocyanine pigment are preferred. Among the phthalocyanine pigment, oxy-titanium phthalocyanine, chlorogallium phthalocyanine, and hydroxygallium phthalocyanine are preferred.

When the photosensitive layer is a lamination type photosensitive layer, examples of a binder resin used for the charge generating layer include polymers and copolymers of vinyl compounds such as styrene, vinyl acetate, vinyl chloride, acrylic esters, methacrylates, vinylidene fluoride, and trifluoroethylene, polyvinyl alcohol, polyvinyl acetal, polycarbonate, polyester, polysulfone, polyphenylene oxide, polyurethane, cellulosic resins, phenol resins, melamine resins, silicone resins and epoxy resins. Among these, polyester, polycarbonate and polyvinyl acetal are preferred, and among these, polyvinyl acetal is more preferred.

In the charge generating layer, the mass ratio of the charge generating material to the binder resin (charge generating material/binder resin) is preferably in the range of 10/1 to 1/10, more preferably in the range of 5/1 to 1/5.

The thickness of the charge generating layer can be 0.05 μm or more and 5 μm or less.

Examples of the hole transport material include polycyclic aromatic compounds, hetero ring compounds, hydrazone compounds, styryl compounds, benzidine compounds, triarylamine compounds and triphenylamine. Examples of the hole transport material further include polymers each having a group derived from these compounds on the main chain or side chain.

When the photosensitive layer is a lamination type photosensitive layer, examples of the binder resin used for the hole transport layer include polyester, polycarbonate, polymethacrylates, polyarylate, polysulfone and polystyrene. Among these, polycarbonate and polyarylate are preferred. Further, the weight average molecular weight (Mw) thereof can be in the range of 10,000 to 300,000.

In the hole transport layer, the mass ratio of the hole transport material to the binder resin (hole transport material/binder resin) is preferably in the range of 10/5 to 5/10, more preferably in the range of 10/8 to 6/10.

Note that other layers such as a conductive layer in which conductive particles of a metal oxide, or carbon black are dispersed in a resin and a second undercoat layer which does not contain a polymerized product (cured product) of the present invention may be provided between a support and the undercoat layer or between the undercoat layer and a photosensitive layer.

Further, a protective layer (surface protective layer) containing conductive particles or a hole transport material and a binder resin may be provided on a photosensitive layer (on a hole transport layer). The protective layer may further contain an additive such as a lubricant. Further, the resin (binder resin) itself of the protective layer may be imparted with conductivity and hole transportability, and in this case, the protective layer may contain no conductive particles and hole transport materials other than the resin. Further, the binder resin of the protective layer may be a thermoplastic resin or a curable resin to be cured by heat, light, radiation (such as electron beams) or the like.

A method of forming each layer such as an undercoat layer, a charge generating layer and a hole transport layer included in the electrophotographic photosensitive member includes first applying a coating liquid obtained by dissolving and/or dispersing materials included in each layer in a solvent to thereby form a coating film. Next, the resulting coating film can be dried and/or cured to form the layers. Examples of the method of applying the coating liquid include a dip coating method (an immersion coating method), a spray coating method, a curtain coating method and a spin coating method. Among these, the dip coating method is preferred in terms of efficiency and productivity.

[Process Cartridge and Electrophotographic Apparatus]

FIG. 1 illustrates a schematic structure of an electrophotographic apparatus having a process cartridge provided with the electrophotographic photosensitive member of the present invention.

In the electrophotographic apparatus shown in FIG. 1, a cylindrical electrophotographic photosensitive member is rotated at a predetermined circumferential speed in the arrow direction about a rotating shaft 2. The surface (circumferential surface) of the electrophotographic photosensitive member 1 is uniformly charged to a predetermined positive or negative potential by a charging device 3 (for example, a contact-type primary charger, or a non-contact type primary charger) in the course of rotation. Then, the uniformly charged surface of the electrophotographic photosensitive member 1 is exposed with exposure light (image exposure light) 4 (for example, laser light) from an image exposure device (not shown) such as slit exposure and laser beam scanning exposure. In this way, an electrostatic latent image corresponding to the target image is successively formed on the surface of the electrophotographic photosensitive member 1.

The electrostatic latent image formed on the surface of the electrophotographic photosensitive member 1 is then developed with a toner of a developing device 5 (for example, a contact-type developer, or a non-contact-type developer) to form a toner image. The resulting toner image is successively transferred to a transfer material 7 (for example, paper) by a transfer device 6 (for example, transfer charger). The transfer material 7 is taken out from a transfer material feed part (not shown) synchronously with the rotation of the electrophotographic photosensitive member 1 and fed to between the electrophotographic photosensitive member 1 and the transfer device 6.

The transfer material 7 on which the toner image has been transferred is separated from the surface of the electrophotographic photosensitive member 1, introduced into a fixing device 8 to be subjected to image fixation, and is thereby printed out of the electrophotographic apparatus as a reproduction (copy).

The surface of the electrophotographic photosensitive member 1 after toner transfer is subjected to removal of residual toner after transfer by a cleaning device 9 to be cleaned. Next, the cleaned surface of the electrophotographic photosensitive member 1 is subjected to charge elimination treatment with pre-exposure light (not shown) from a pre-exposure device (not shown) and then repeatedly used for image formation.

As the charging device 3, a scorotron charger or a corotron charger utilizing corona discharge may be used, or a contact-type charger equipped with a charging member having a roller shape, a blade shape, a brush shape or the like may be used.

In the present invention, at least one device selected from the components such as the charging device 3, the developing device 5 and the cleaning device 9 may be integrally supported with the electrophotographic photosensitive member 1 to form a process cartridge. Then, the process cartridge may be designed to be detachably attachable to the main body of an electrophotographic apparatus. For example, at least one device selected from the group consisting of the charging device 3, the developing device 5 and the cleaning device 9 is integrally supported together with the electrophotographic photosensitive member 1 to form a cartridge. By using a guiding device such as rails 11 and 12 of the main body of the electrophotographic apparatus, this can form a process cartridge 10 which is detachably attachable to the main body of the electrophotographic apparatus.

EXAMPLE

Hereinafter, the present invention will be described in more detail by way of Examples and Comparative Examples, but the present invention is not limited to these Examples. Note that "parts" in Examples and Comparative Examples means "parts by mass".

First, the Synthesis Example of an electron-transporting compound in the present invention will be shown. The compound was synthesized mainly using a synthetic method described in Japanese Patent Application Laid-Open No. 2007-108670.

Synthesis Example

Into a 300-ml three-necked flask, 26.8 g (100 mmol) of 1,4,5,8-naphthalenetetracarboxylic dianhydride and 150 ml of dimethylacetamide were charged under a nitrogen flow at room temperature. Thereto, a mixture of 11.7 g (100 mmol) of L-(+)-leucinol and 25 ml of dimethylacetamide was dropwise added with stirring. After completion of dropwise adding, the resulting mixture was heated to 100° C. and then stirred at the temperature for 6 hours. After completion of reaction, the container was cooled, and the mixture was concentrated under vacuum. Ethyl acetate was added to the residue, and the residue was purified by silica gel column chromatography. Further, the purified product was recrystallized from ethyl acetate/hexane to obtain 15.1 g of a monoimide in which a butanol structure was introduced only into one side. Into a 300-ml three-necked flask, 7.3 g of the monoimide (20 mmol), 1.5 g (20 mmol) of 2-hydrazinoethanol and 50 ml of dimethylacetamide were charged, and the mixture was refluxed under heating for 5 hours. After the reflux under heating, the container was cooled, and the mixture was concentrated under vacuum. The residue was purified by silica gel column chromatography. Further, the purified product was recrystallized from toluene/ethyl acetate to obtain 2.11 g of the illustrated compound (E1).

Next, production and evaluation of the electrophotographic photosensitive member will be described below.

Example 1

An aluminum cylinder (JIS-A3003, aluminum alloy) having a length of 260.5 mm and a diameter of 30 mm was used as a support (conductive support).

Next, 50 parts of titanium oxide particles coated with oxygen-deficient tin oxide (powder resistivity: 120 Ω·cm, coverage of tin oxide: 40%), 40 parts of a phenolic resin (PLYOPHEN J-325, manufactured by DIC Corporation, resin solid content: 60%) and 55 parts of methoxypropanol were charged into a sand mill containing glass beads having a diameter of 1 mm and subjected to dispersion treatment for 3 hours to prepare a coating liquid for a conductive layer.

The average particle size of the titanium oxide particles coated with oxygen-deficient tin oxide in the coating liquid for a conductive layer was measured with a particle size distribution analyzer manufactured by Horiba, Ltd. (trade name: CAPA700) by a centrifugal sedimentation method at a rotation speed of 5,000 rpm using tetrahydrofuran as a dispersion medium. As a result, the average particle size was found to be 0.30 μm.

The coating liquid for a conductive layer was applied to the support by dip coating to form a coating film, and the resulting coating film was dried and heat-cured at 160° C. for 30 minutes, thereby forming a conductive layer having a thickness of 18 μm.

Next, 4 parts of the illustrated compound (E1), 1.5 parts of a polyvinyl butyral resin (BX-1: manufactured by Sekisui Chemical Co., Ltd.) and 0.0005 parts of dioctyltin laurate as a catalyst were dissolved in a mixed solvent of 100 parts of dimethylacetamide and 100 parts of tetrahydrofuran. To the resulting solution, a blocked isocyanate resin (BL3175: manufactured by Sumika Bayer Urethane Co., Ltd.) corresponding to 8 parts of solids was added to prepare a coating liquid for an undercoat layer.

The coating liquid for an undercoat layer was applied to the conductive layer by dip coating, and the resulting coating film was heated at 160° C. for 40 minutes to evaporate the solvent and cure the coating film to thereby form an undercoat layer having a thickness of 1.5 μm.

Next, a hydroxygallium phthalocyanine crystal (charge generating material) with a crystal form having peaks at Bragg angles (2θ±0.2°) of 7.5°, 9.9°, 12.5°, 16.3°, 18.6°, 25.1°, and 28.3° in CuKα characteristic X-ray diffraction was prepared. Ten parts of the hydroxygallium phthalocyanine crystal, 5 parts of polyvinyl butyral (trade name: S-LEC BX-1, manufactured by Sekisui Chemical Co., Ltd.) and 250 parts of cyclohexanone were charged into a sand mill containing glass beads having a diameter of 1 mm and subjected to dispersion treatment for 2 hours. Next, 250 parts of ethyl acetate was added to the resulting dispersion to prepare a coating liquid for a charge generating layer.

The coating liquid for a charge generating layer was applied to the undercoat layer by dip coating to form a coating film, and the resulting coating film was dried at 95° C. for 10 minutes to form a charge generating layer having a thickness of 0.15 μm.

Next, 8 parts of an amine compound (hole transport material) represented by the following formula (3), and 10 parts of a polyarylate having a weight average molecular weight (Mw) of 100000 which has structural units represented by the following formula (4) were dissolved in a mixed solvent of 40 parts of dimethoxymethane and 60 parts of chlorobenzene to thereby prepare a coating liquid for a hole transport layer.

The coating liquid for a hole transport layer was applied to the charge generating layer by dip coating to form a coating film, and the resulting coating film was dried at 120° C. for 40 minutes to thereby form a hole transport layer having a thickness of 15 μm.

(3)

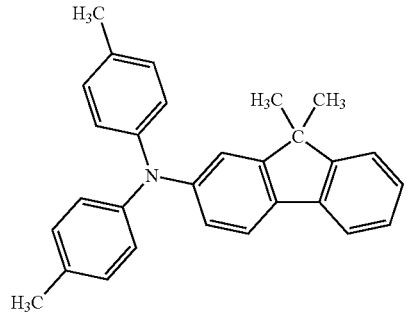

(4)

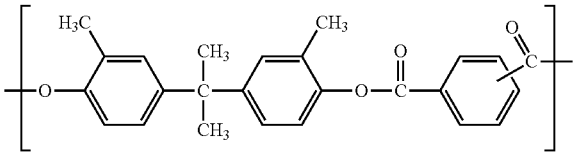

In this way, an electrophotographic photosensitive member having a conductive layer, an undercoat layer, a charge generating layer, and a hole transport layer on a support was produced.

The electrophotographic photosensitive member produced was mounted on a modified machine (primary charging: roller contact DC charging, process speed: 120 mm/second, laser exposure) of a laser beam printer manufactured by Canon Inc. (trade name: LBP-2510) in an environment at a temperature of 23° C. and a humidity of 50% RH. The output images were evaluated using a laser beam printer on which the electrophotographic photosensitive member produced was mounted. Details will be described below.

(Image Evaluation)

The electrophotographic photosensitive member produced was mounted on a cyan process cartridge of the above modified laser beam printer, and the process cartridge was mounted on a cyan process cartridge station to output images.

First, a solid white image (1 sheet), images for ghosting evaluation (5 sheets), a solid black image (1 sheet) and images for ghosting evaluation (5 sheets) were continuously output in this order.

Figure 2:
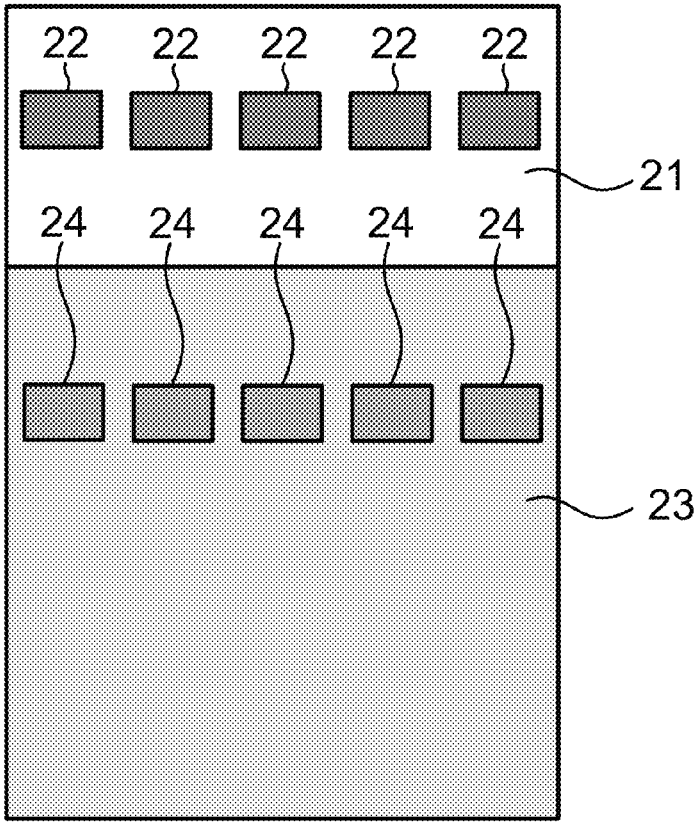
FIG. 2 is a diagram for describing an image for ghosting evaluation (printing for ghosting evaluation).
Figure 3:
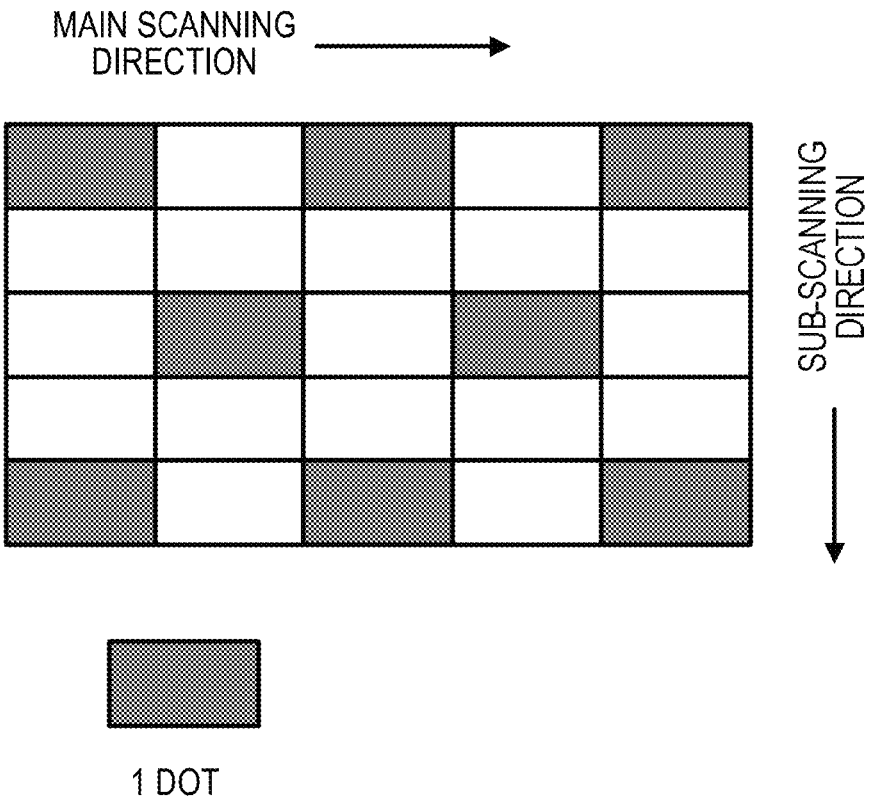
FIG. 3 is a diagram for describing a one-dot keima (similar to knight's move) pattern image.

As illustrated in FIG. 2, the image for ghosting evaluation is an image in which quadrangular solid images 22 were output in a white image 21 at the upper portion of the image, and then a half-tone image of a one-dot Keima pattern image 23 illustrated in FIG. 3 was prepared.

The positive ghosting was evaluated by measuring the density difference between the image density of the half-tone image of the one-dot Keima pattern and the image density of ghosting portions 24 (portions in which positive ghosting can occur). The density difference was measured at ten points in one sheet of the image for ghosting evaluation with a spectrodensitometer (trade name: X-Rite 504/508, manufactured by X-Rite Inc.). This operation was performed on all of the ten sheets of the images for ghosting evaluation, and the average of the results of the total of 100 points was calculated. The results are shown in Table 6. The higher the density of the ghosting portion, the more strongly the positive ghosting has occurred. The smaller the density, the more the positive ghosting has been suppressed.

Example 2

An electrophotographic photosensitive member was produced in the same manner as in Example 1 except that 2 parts of the illustrated compound (E1) and 2 parts of the illustrated compound (E2) were used, and the evaluation of ghosting was also performed in the same manner. The results are shown in Table 6.

Examples 3 to 36

Electrophotographic photosensitive members were produced in the same manner as in Example 1 except that the type and parts by mass of the illustrated compound, crosslinking agent and resin were changed as shown in Table 6, and the evaluation of ghosting was also performed in the same manner. The results are shown in Table 6.

Examples 37 to 39

Coating liquids for undercoat layers were prepared in the same manner as in Example 1 except that the type of the illustrated compound was changed as shown in Table 6; the resin was not used; an acrylic crosslinking agent (A-TMPT: manufactured by Shin-Nakamura Chemical Co., Ltd.) represented by the following formula (5) was used instead of the isocyanate compound; and AIBN was used instead of dioctyltin laurate as a catalyst. Further, coating films of coating liquids for undercoat layers were formed; electrophotographic photosensitive members were produced in the same manner as in Example 1 except that the coating films were heated under a nitrogen flow; and the evaluation of ghosting was also performed in the same manner. The results are shown in Table 6.

(5)

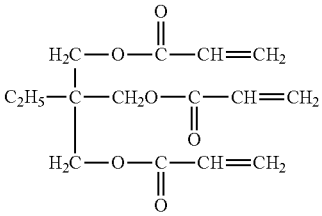

Example 40

An electrophotographic photosensitive member was produced in the same manner as in Example 1 except that the amine compound (hole transport material) represented by the above formula (3) was changed to 4 parts of a compound represented by the following formula (9) and 4 parts of a compound represented by the following formula (10), and the evaluation of ghosting was also performed in the same manner. The results are shown in Table 6.

(9)

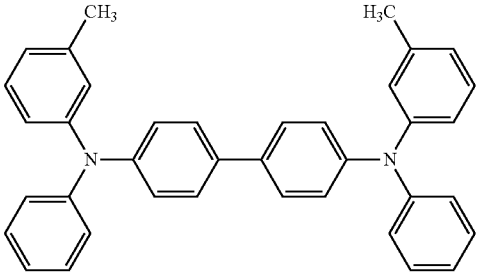

-continued (10)

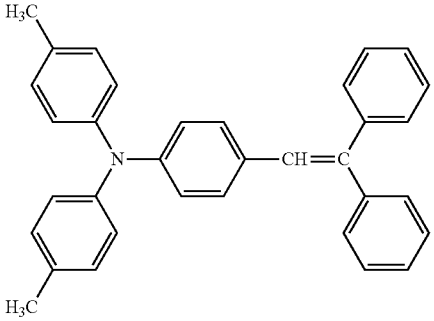

Comparative Example 1

An electrophotographic photosensitive member was produced in the same manner as in Example 1 except that a coating liquid for an undercoat layer was prepared using 4 parts of a compound represented by the following formula (6), 4.8 parts of a polycarbonate Z-type resin (Iupilon Z400, manufactured by Mitsubishi Gas Chemical Co., Inc.), 100 parts of dimethylacetamide and 100 parts of tetrahydrofuran, and the evaluation of ghosting was also performed in the same manner. The results are shown in Table 6.

(6)

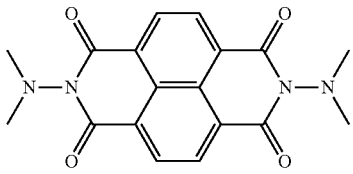

Comparative Example 2

An electrophotographic photosensitive member was produced in the same manner as in Example 1 except that a compound represented by the following formula (7) was used; a resin described in Table 6 was used; and a crosslinking agent was not used, and the evaluation of ghosting was also performed in the same manner. The results are shown in Table 6.

(7)

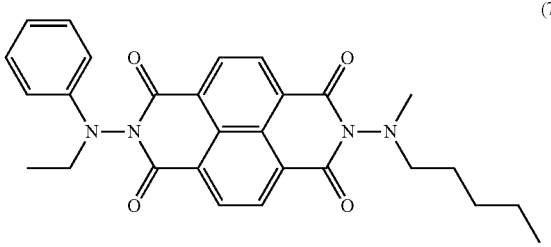

Comparative Example 3

An electrophotographic photosensitive member was produced in the same manner as in Example 1 except that a compound represented by the following formula (8) was used, and a resin described in Table 6 was used, and the evaluation of ghosting was also performed in the same manner. The results are shown in Table 6.

(8)

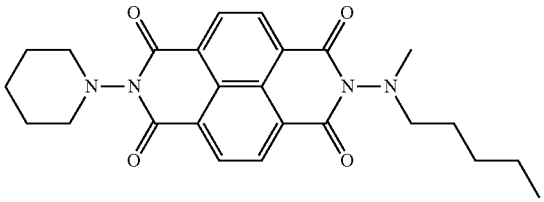

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-270561, filed on Dec. 26, 2013 and No. 2014-246838, filed on Dec. 5, 2014, which are hereby incorporated by reference herein in their entirety.

TABLE 6

| Example No | Compound | Parts by mass | Crosslinking agent | Part by mass (solids) | Resin | Part by mass (solids) | Macbeth density (initial) |
|---|---|---|---|---|---|---|---|
| 1 | E1 | 4 | BL3175 (*1) | 8 | BX-1 (*2) | 1.5 | 0.025 |
| 2 | E1, E2 | 4 | BL3175 | 8 | BX-1 | 1.5 | 0.027 |
| 3 | E3 | 4 | BL3175 | 8 | BX-1 | 1.5 | 0.025 |
| 4 | E8 | 4 | BL3575 (*3) | 6 | BX-1 | 1.5 | 0.026 |
| 5 | E9 | 4 | BL3175 | 10 | BX-1 | 1.5 | 0.025 |
| 6 | E12 | 4 | BL3175 | 6 | BX-1 | 1.5 | 0.027 |
| 7 | E14 | 4 | BL3175 | 8 | BX-1 | 1.5 | 0.026 |
| 8 | E15 | 4 | BL3175 | 6 | BM-1 (*4) | 1.5 | 0.027 |
| 9 | E18 | 4 | BL3175 | 6 | BX-1 | 1.5 | 0.026 |
| 10 | E19 | 4 | BL3175 | 8 | BX-1 | 1.5 | 0.025 |
| 11 | E23 | 4 | BL3175 | 8 | BX-1 | 1.5 | 0.028 |
| 12 | E32 | 4 | BL3175 | 10 | BX-1 | 1.5 | 0.031 |
| 13 | E34 | 4 | BL3175 | 8 | BX-1 | 1.5 | 0.032 |
| 14 | E45 | 4 | BL3175 | 9 | BX-1 | 1.5 | 0.036 |
| 15 | E47 | 4 | BL3175 | 10 | BL-1 (*5) | 1.5 | 0.036 |
| 16 | E50 | 4 | BL3575 | 12 | BL-1 | 1.5 | 0.037 |
| 17 | E51 | 4 | BL3175 | 12 | BX-1 | 1.5 | 0.037 |
| 18 | E55 | 4 | BL3175 | 7 | BX-1 | 1.5 | 0.036 |
| 19 | E69 | 4 | BL3575 | 11 | BX-1 | 1.5 | 0.032 |
| 20 | E72 | 4 | BL3175 | 11 | BX-1 | 1.5 | 0.032 |
| 21 | E2 | 4 | J821-60 (*6) | 10 | BX-1 | 1.5 | 0.026 |
| 22 | E4 | 4 | J821-60 | 10 | BX-1 | 1.5 | 0.027 |
| 23 | E25 | 4 | J821-60 | 8 | BM-1 | 1.5 | 0.029 |
| 24 | E36 | 4 | J821-60 | 6 | BX-1 | 1.5 | 0.032 |
| 25 | E41 | 4 | J821-60 | 6 | BX-1 | 1.5 | 0.032 |
| 26 | E46 | 4 | J821-60 | 12 | BX-1 | 1.5 | 0.036 |
| 27 | E53 | 4 | J821-60 | 5 | BX-1 | 1.5 | 0.037 |
| 28 | E73 | 4 | J821-60 | 10 | BX-1 | 1.5 | 0.039 |
| 29 | E44 | 4 | BL3175 | 6 | BX-1 | 1.5 | 0.033 |
| 30 | E58 | 4 | BL3175 | 10 | BM-1 | 1.5 | 0.037 |
| 31 | E59 | 4 | J821-60 | 12 | BX-1 | 1.5 | 0.037 |
| 32 | E60 | 4 | J821-60 | 10 | BX-1 | 1.5 | 0.036 |
| 33 | E43 | 4 | BL3175 | 10 | BX-1 | 1.5 | 0.033 |
| 34 | E64 | 4 | BL3175 | 4 | BX-1 | 1.5 | 0.037 |
| 35 | E63 | 4 | J821-60 | 12 | BX-1 | 1.5 | 0.037 |
| 36 | E65 | 4 | J821-60 | 5 | BX-1 | 1.5 | 0.036 |
| 37 | E66 | 4 | TMPT(*7) | 2 | BX-1 | — | 0.039 |
| 38 | E67 | 4 | TMPT | 3 | BX-1 | — | 0.039 |
| 39 | E68 | 4 | TMPT | 2 | BX-1 | — | 0.038 |
| 40 | E1 | 4 | BL3175 | 8 | BX-1 | 1.5 | 0.026 |
| Comparative Example 1 | Compound (6) | 4 | — | | Z400 (*8) | 4.8 | 0.121 |
| Comparative Example 2 | Compound (7) | 4 | — | | BX-1 | 1.5 | 0.103 |
| Comparative Example 3 | Compound (8) | 4 | BL3175 | | BX-1 | 1.5 | 0.096 |

*1 BL3175: isocyanate crosslinking agent (solid content: 60%) Desmodur, manufactured by Sumika Bayer Urethane Co., Ltd.

*2 BX-1: polyvinyl acetal resin S-LEC, manufactured by Sekisui Chemical Co., Ltd.

*3 BL3575: isocyanate crosslinking agent (solid content: 60%) Desmodur, manufactured by Sumika Bayer Urethane Co., Ltd.

*4 BM-1: polyvinyl acetal resin S-LEC, manufactured by Sekisui Chemical Co., Ltd.

*5 BL-1: polyvinyl acetal resin S-LEC, manufactured by Sekisui Chemical Co., Ltd.

*6 J821-60: butyrated melamine crosslinking agent (solid content: 60%) SUPER BECKAMINE, manufactured by DIC Corporation

*7 A-TMPT: trimethylolpropane triacrylate, manufactured by Shin-Nakamura Chemical Co., Ltd.

*8 2400: Z-type polycarbonate Iupilon, manufactured by Mitsubishi Gas Chemical Co., Inc.

What is claimed is:

1. An electrophotographic photosensitive member comprising:

a support;

an undercoat layer on the support; and a photosensitive layer on the undercoat layer, wherein the undercoat layer comprises following (i) or (ii), (i) a polymerized product of at least one compound selected from the group consisting of a compound represented by the following formula (1) and a compound represented by the following formula (2), (ii) a polymerized product of a composition comprising at least one compound selected from the group consisting of a compound represented by the following formula (1) and a compound represented by the following formula (2), (1)

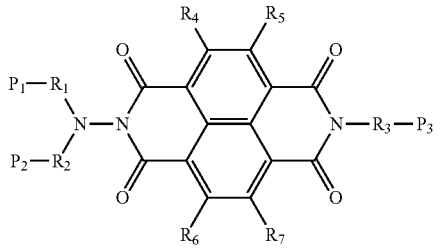

(2)

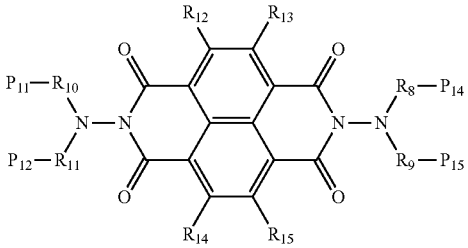

wherein, in the formulae (1) and (2), $R_1$ to $R_3$ and $R_8$ to $R_{11}$ each independently represent a hydrogen atom, an unsubstituted or substituted arylene group, an unsubstituted or substituted hetero ring, an unsubstituted or substituted alkylene group having 1 to 6 main-chain atoms, a divalent group having 1 to 6 main-chain atoms and derived from one of $CH_2$ in the main chain of an unsubstituted or substituted alkylene group substituted for an oxygen atom, or a divalent group having 1 to 6 main-chain atoms and derived from one of $CH_2$ in the main chain of an unsubstituted or substituted alkylene group substituted for a sulfur atom, a substituent of the substituted alkylene group is an alkyl group having 1 to 6 carbon atoms, a benzyl group, an alkoxycarbonyl group, or a phenyl group, $R_1$ may combine with $R_2$ to form an unsubstituted or substituted hetero ring, $P_2$ is absent when $R_1$ combines with $R_2$ to form the hetero ring, $R_8$ may combine with $R_9$ to form an unsubstituted or substituted hetero ring, $P_{15}$ is absent when $R_8$ combines with $R_9$ to form the hetero ring, $R_{10}$ may combine with $R_{11}$ to form an unsubstituted or substituted hetero ring, $P_{12}$ is absent when $R_{10}$ combines with $R_{11}$ to form the hetero ring, $R_4$ to $R_7$ and $R_{12}$ to $R_{15}$ each independently represent a hydrogen atom, a cyano group, a nitro group, a halogen atom, an unsubstituted or substituted alkyl group, or an unsubstituted or substituted aryl group, $P_1$ is absent when $R_1$ is a hydrogen atom, $P_2$ is absent when $R_2$ is a hydrogen atom, $P_3$ is absent when $R_3$ is a hydrogen atom, $P_{14}$ is absent when $R_8$ is a hydrogen atom, $P_{15}$ is absent when $R_9$ is a hydrogen atom, $P_{11}$ is absent when $R_{10}$ is a hydrogen atom, $P_{12}$ is absent when $R_{11}$ is a hydrogen atom, $P_1$ to $P_3$ each independently represents a hydrogen atom or a polymerizable functional group, at least one of $P_1$ to $P_3$ is a polymerizable functional group, $P_{11}$, $P_{12}$, $P_{14}$ and $P_{15}$ each independently represent a hydrogen atom or a polymerizable functional group, and at least one of $P_{11}$, $P_{12}$, $P_{14}$ and $P_{15}$ is a polymerizable functional group.

2. The electrophotographic photosensitive member according to claim 1, wherein the polymerizable functional group is an active hydrogen group.

3. The electrophotographic photosensitive member according to claim 2, wherein the active hydrogen group is at least one selected from the group consisting of a hydroxy group, a carboxyl group, an amino group and a thiol group.

4. The electrophotographic photosensitive member according to claim 3, wherein the active hydrogen group is at least one selected from the group consisting of a hydroxy group and a carboxyl group.

5. The electrophotographic photosensitive member according to claim 1, wherein the composition of the (ii) further comprises a crosslinking agent.

6. The electrophotographic photosensitive member according to claim 5, wherein the crosslinking agent is an isocyanate compound having an isocyanate group or a blocked isocyanate group or an amine compound having an N-methylol group or an alkyl-etherified N-methylol group.

7. The electrophotographic photosensitive member according to claim 5, wherein the mass ratio of the compound represented by the formula (1) and/or the compound represented by the formula (2) to the crosslinking agent is 100:50 or more and 100:250 or less.

8. The electrophotographic photosensitive member according to claim 5, wherein the composition of the (ii) further contains a resin having a polymerizable functional group.

9. The electrophotographic photosensitive member according to claim 8, wherein the polymerizable functional group of the resin is a hydroxy group, a thiol group, an amino group, a carboxyl group or a methoxy group.

10. The electrophotographic photosensitive member according to claim 1, wherein the polymerizable functional group is an unsaturated hydrocarbon group.

11. The electrophotographic photosensitive member according to claim 10, wherein the unsaturated hydrocarbon group is at least one selected from the group consisting of an acryloyloxy group and a methacryloyloxy group.

12. The electrophotographic photosensitive member according to claim 1, wherein, in the formulae (1) and (2), a hetero ring group in which $R_1$ combines with $R_2$, a hetero ring group in which $R_8$ combines with $R_9$ and a hetero ring group in which $R_{10}$ combines with $R_{11}$ are selected from the following group:

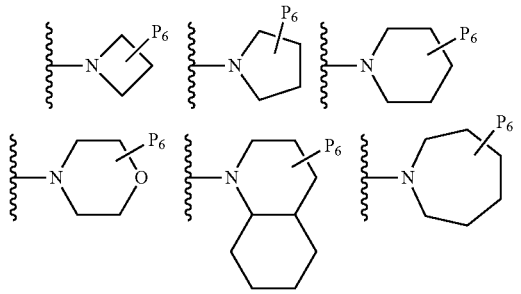

wherein $P_6$ represents $P_1$, $P_{11}$ or $P_{14}$ in the above formula (1) or (2).

13. The electrophotographic photosensitive member according to claim 1, wherein the number of the polymerizable functional groups of the compound represented by the formula (1) or (2) is 2 or more.

14. A process cartridge detachably attachable to a main body of an electrophotographic apparatus, wherein the process cartridge integrally supports: the electrophotographic photosensitive member according to claim 1; and at least one device selected from the group consisting of a charging device, a developing device and a cleaning device.

15. An electrophotographic apparatus, comprising:

the electrophotographic photosensitive member according to claim 1, a charging device, an image exposure device, a developing device, and a transfer device.

* * * * *